United States Patent [19]

LeRoy

[11] 4,039,402

[45] Aug. 2, 1977

[54] METHOD FOR THE OPERATION OF A FLUIDIZED BED ELECTROCHEMICAL REACTOR AT A SUBSTANTIALLY CONSTANT CURRENT DENSITY

[75] Inventor: Rodney L. LeRoy, Pointe Claire, Canada

[73] Assignee: Noranda Mines Limited, Toronto, Canada

[21] Appl. No.: 662,224

[22] Filed: Feb. 27, 1976

[30] Foreign Application Priority Data

Nov. 28, 1975 Canada ..... 240695

[51] Int. Cl.[2] ..... C25C 1/00; C25C 1/12; C25C 7/08; C25C 11/02

[52] U.S. Cl. ..... 204/105 R; 204/106; 204/222

[58] Field of Search ..... 204/105 R, 222

[56] References Cited

U.S. PATENT DOCUMENTS 3,787,293 1/1974 Kametani ..... 204/108

*Primary Examiner*—R. L. Andrews

*Attorney, Agent, or Firm*—Fleit & Jacobson

[57] ABSTRACT

A method for the operation of a fluidized bed electrochemical reactor at a substantially constant current density for a prolonged period of time is disclosed. The method consists of electrowinning semi-continuously or continuously for a number of periods of predetermined duration. During each period the electrowon weight plus some fraction of the weight of powder is withdrawn from the bed and a predetermined amount of the starting powder is added to maintain the total surface area of the fluidized bed electrode approximately constant.

6 Claims, 3 Drawing Figures

METHOD FOR THE OPERATION OF A FLUIDIZED BED ELECTROCHEMICAL REACTOR AT A SUBSTANTIALLY CONSTANT CURRENT DENSITY

This invention relates to the operation of a fluidized bed electrochemical reactor at a substantially constant current density for a prolonged period of time.

Fluidized bed electrochemical reactors generally comprise a main electrode made of fine metal or metal coated particles supported by a porous base in a suitable vessel. The particles are fluidized, that is are kept in constant and random motion with respect to each other, by forced flow of an electrolyte through the porous base or otherwise. Current is fed to the fluidized bed from heavy metal feeder rods with which the bed particles come into frequent contact in their constant motion. In electrowinning applications, a counter electrode in the form of a metal bar or rod is inserted into the metallic particles of the fluidized electrode and electrically insulated therefrom.

Fluidized bed electrochemical reactors have been actively developed over the past years, and they offer many advantages over conventional plating technologies in metal electrowinning applications. For example, fluidized bed electrodes can be operated in a continuous or semi-continuous manner; high production rates can be achieved in relatively small plant areas; and electrowinning can be carried out at high efficiencies even when the concentration of the electrowon metal is very low in solution.

The very large surface area of the fluidized bed electrode causes the electrode to operate at a very low current density. Therefore, an additional important potential advantage of electrowinning on a fluidized bed electrode is that, because of the low current density, it is possible to separate reactions which have very similar electrochemical potentials. However, in order for this advantage to be realized in practice, the current density on a fluidized bed electrode must remain approximately constant with time. This is normally not the case with electrodes operated as described in the prior art, for reasons which are outlined below.

As metal values are electrowon from an electrolyte onto a fluidized bed electrode, the particles comprising the electrode grow in size, and the weight of the fluidized bed electrode increases. The total surface area of the electrode also increases, and the current density on it decreases. It is not possible to operate a fluidized bed electrode without interruption for a prolonged period of time since the size of the particles in the bed eventually become so large that fluidization is no longer possible. Therefore, at some point, the electrowinning process must be stopped and some of the bed material withdrawn (for example a weight equal to the electrowon weight). Electrowinning can then be continued until again more weight is withdrawn from the bed.

In this operating mode, however, the number of particles in the fluidized bed electrode decreases sharply on each withdrawal, and the average diameter of the bed particles steadily grows. Eventually, a point will be reached where the bed can no longer be fluidized, and the electrode must be replaced with fresh fine powder which can again be fluidized. Because of the time and effort required to replace the powder in a commercial scale fluidized bed electrode, and because of the high cost of fresh powder, this type of operation would normally not be feasible.

Even if economic considerations were not important, a second factor weights heavily against operating a fluidized bed electrode in the above described manner. As the number of particles in the electrode drops on each successive withdrawal of powder, the total surface area of the electrode also drops. Since the total current applied to the cell is likely to be held constant, this has the effect that the true current density in the bed rises significantly with time. If the fluidized bed is being used to separate two electrochemically similar reactions, such variation in the operating current density can completely destroy the proper functioning of the bed.

It has been proposed to achieve semi-continuous operation of a fluidized bed electrode by periodically withdrawing a weight of powder equal to the weight added by electrowinning, plus some fraction of the original bed weight. Some of the original fine bed material is then added to makeup a part or all of the weight deficit. Regular addition of fine powder would tend to prevent the number of particles in the bed from falling too sharply, to keep the true current density in the bed from rising unacceptably, and to prevent the mean particle diameter from rising to the point where the bed can no longer be fluidized. In fact, experience has shown that a mixture of fine and coarse particles in the bed can facilitate fluidization.

Although the above disclosed mode of operation represents an improvement over the first mentioned method, the problem with this mode of operation is that the number of particles in the electrode gradually decreases from cycle to cycle, and their average size increases, so that a situation is reached where fluidization is still no longer possible. A further problem is that because of the decreasing number of particles, the true current density on the fluidized bed electrode increases from cycle to cycle. This may present serious difficulties when the fluidized bed electrode is being used to separate two electrochemically similar reactions.

It is therefore the object of the present invention to provide a method whereby a fluidized bed electrochemical reactor can be operated at a substantially constant current density for a prolonged period of time.

The method, in accordance with the invention, consists in electrowinning semi-continuously or continuously for a number of periods of predetermined duration by withdrawing from the fluidized bed during each period a weight of particles equal to the electrowon weight plus some fraction of the bed weight, and adding to the fluidized bed during each period a predetermined weight of the original particles to maintain the total surface area of the fluidized bed electrode approximately constant.

In semi-continuous electrowinning, the particle removals and additions preferably take place at the end of each electrowinning cycle.

The fraction of the starting bed weight removed at each cycle is normally higher than 5% and preferably between about 5 and 20%.

The weight of fine particles added to the fluidized bed at the beginning of each subsequent cycle is generally determined by the following formula:

$$W_{in}^{i+1} = W_o\left[1 - \frac{W_i(1 - X_f)}{W_i + G}\ \frac{S_i}{S_o}\right]$$

wherein:

$W_o$ = original electrode weight $S_o$ = original total surface area of the electrode $W_i$ = electrode weight at the beginning of the preceding cycle G = electrowon weight $X_f$ = fraction of the weight $W_i$ of the electrode withdrawn in addition to the electrowon weight, and $S_i$ = total surface area of the electrode at the end of the preceding cycle.

The invention will now be disclosed with reference to the accompanying drawings in which.

CALCULATION OF FLUIDIZED BED PROPERTIES

Figure 1:
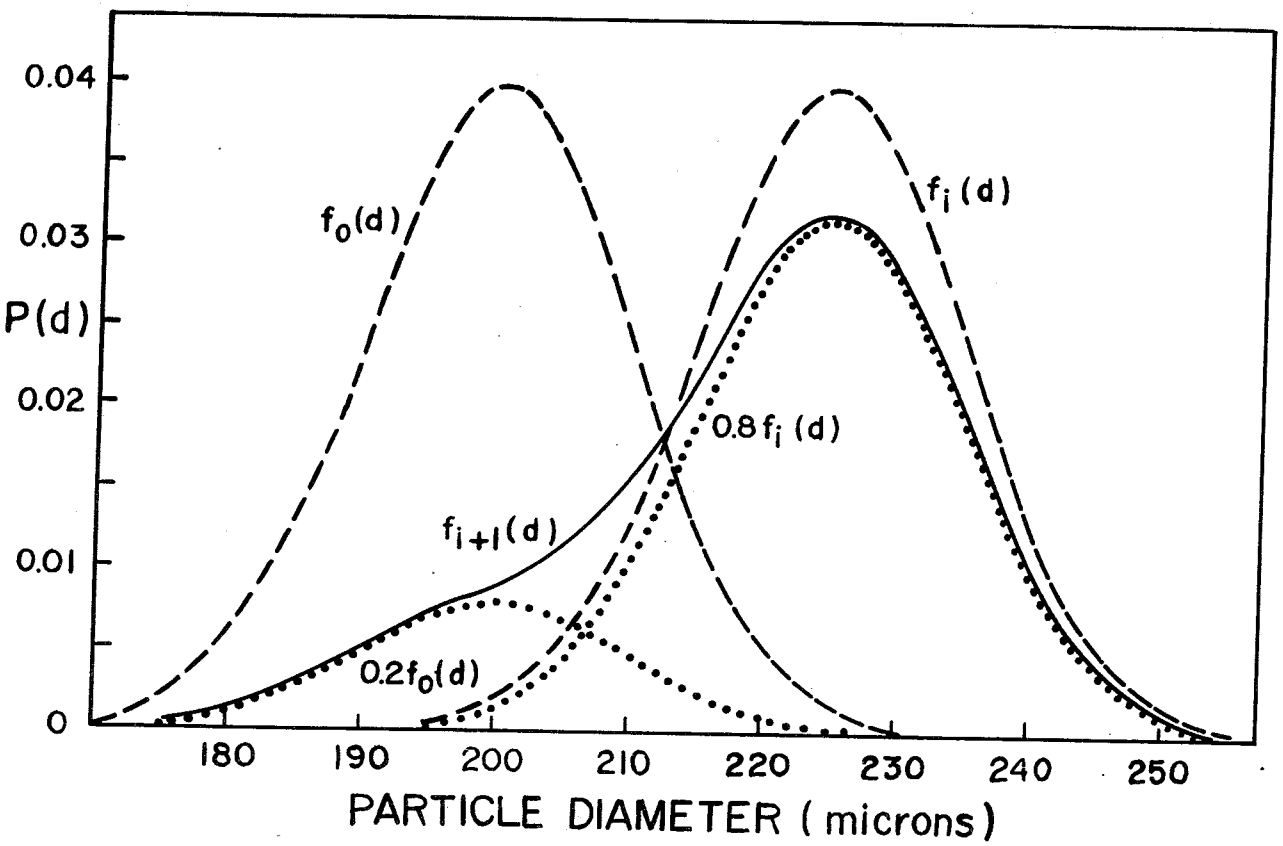
FIG. 1 illustrates the mechanism of calculating the evolving properties of the fluidized electrode.

In the discussion which follows, the invention is illustrated by the example of a fluidized bed composed of spherical particles. However the general evolution of bed properties in an electrode composed of non-spherical particles will be qualitatively the same as in an electrode composed of spherical particles, and the results of these calculations can still be used to estimate a suitable operating cycle.

Three properties of the spherical fluidized bed particles completely determine their aggregate physical parameters: the density of bed material, the total bed weight, and the distribution of particle diameters P(d) $d$(d). The distribution function is specifically the fraction of bed particles having diameters between $d$ and $d + d$(d) as shown by curve $F_O$(d) in FIG. 1 of the drawings.

a. Number of Particles in the Bed

The number of particles in the fluidized bed can be calculated by equating the total volume of bed material, calculated from its weight and density, with the sum of the volumes of all the constituent particles of which it is composed. Thus $$W/\rho = \sum_{\substack{\text{all}\\ \text{particles}}} \left[\frac{\pi}{6} d_i^3\right].$$

The summation on the right hand side of this equation can be replaced by an integration over all particle diameters:

$$W/\rho = \int_0^\infty \frac{\pi}{6} d^3 N P(d)\, d(d)$$

where N is the total number of particles in the bed, and N P(d) $d$(d) is the number of particles in the bed having diameters between $d$ and $d + d$(d).

Rearrangement gives the desired expression for N:

(1)

-continued $$N = \frac{\frac{6W}{\pi\rho}}{\int_0^\infty d^3 P(d)\, d(d)}.$$

b. The Total Surface Area of Particles in the Bed

The true current density in the bed must be known if the time evolution of particle diameters is to be calculated. Since the total current applied to the bed is a known parameter, the current density can be calculated if the total surface area of the bed is known.

This total surface area, S, is calculated by summing the surface area of all the particles comprising the bed:

$$S = \sum_{\substack{\text{all}\\ \text{particles}}} [\pi d_i^2].$$

The summation in this equation is replaced by an integral to give $$S = N\pi \int_0^\infty d^2 P(d)\, d(d), \tag{2}$$

and this expression can be evaluated directly since N is known (equation (1)).

The average current density on the fluidized electrode is derived directly from the calculated value of the total surface area:

$$C_d = I/S \tag{3}$$

where I is the total applied current passing through the cell. It is argued below that the current density is approximately constant over all the particles of the fluidized bed, and thus that the value of $C_d$ calculated from equation (3) is the true current density on the electrode.

THE STARTING BED a. Form of the Distribution

There are many possible functions which could describe the distribution of particle diameters in a fluidized bed electrode at the beginning of an electrowinning process. The distribution applying in a particular case will reflect the source of the powder, and the way in which it is prepared. In what follows, the invention is illustrated for the case where the distribution of particle diameters in the fluidized electrode is Gaussian. This might represent powder produced directly in a manufacturing process with a mean diameter ($\mu$) and a standard deviation ($\delta$). This type of distribution is completely defined by the two parameters $\mu$ and $\delta$ through the following function:

$$P(d)d(d) = \frac{1}{\sqrt{2\pi}\,\sigma} \exp\left\{-\left(\frac{d-\mu}{\sigma}\right)^2/2\right\} d(d). \tag{4}$$

The differences between possible distributions do not lead to significant differences in the equilibrium condition of the fluidized bed and only the normal distribution of FIG. 1 has been considered in characterizing the properties of fluidized beds under semi-continuous operating conditions as it will be disclosed in the following part of this specification.

b. Properties of the Starting Bed

Using the Normal or Gaussian starting distribution of equation (4), the parameters of the fluidized electrode at the start of the electrowinning process can be calculated analytically. Substituting P(d) from equation (4) into equation (1), the number of particles $N_o$ in the starting bed is $$N_o = \frac{6W_o}{\rho}\sqrt{\frac{2}{\pi}} \Big/ \left\{ \sigma_o^3\left[2 - \left(\frac{\mu_o}{\sigma_o}\right)^2\right] \cdot \exp\left[-\left(\frac{\mu_o}{\sigma_o}\right)^2 / Z\right] + \mu_o\sqrt{\frac{\pi}{2}}\left[1 + \operatorname{erf}\left(\frac{\mu_o}{\sqrt{2}\,\sigma_o}\right)\right][3\sigma_o^2 + \mu_o^2]\right\} \quad (5)$$

where the subscript o denotes the values of parameters at the beginning of the process.

In the extreme situation where all particles in the bed have the same diameter $\mu_o$, equation (5) reduces to $$\lim_{\sigma_o \to 0} (N_o) = \frac{W_o/\rho}{\frac{\pi}{6}\mu_o^3}.$$

This is just the total volume of bed particles, divided by the volume of a particle of diameter $\mu_o$.

The total surface area $S_o$ of the starting bed can also be calculated analytically from equation (2), substituting P(d) from equation (4):

$$S_o = N_o\sqrt{\frac{\pi}{2}}\left\{\mu_o\sigma_o \exp\left[-\left(\frac{\mu_o}{\sigma_o}\right)^2/2\right] + \sqrt{\frac{\pi}{2}}\left[1 + \operatorname{erf}\left(\frac{\mu_o}{\sqrt{2}\,\sigma_o}\right)\right][\sigma_o^2 + \mu_o^2]\right\}.$$

In the limit of constant particle diameter $\mu_o$ this expression becomes $$\lim_{\sigma_o \to 0} (S_o) = N_o(\pi\mu_o^2),$$

which is just the number of particles in the bed, multiplied the surface area of a particle of diameter $\mu_o$.

The initial current density on the fluidized electrode can be calculated directly from equation (3), using the value of $S_o$ from equation (6).

Some typical values of the starting parameters of a fluidized electrode are recorded in Table I for two mean particle diameters. Current density values correspond to a total applied current of 200 amperes and a 27 pound electrode. The results show that initial parameters of an electrode having a distribution of particle diameters are not greatly different than those which would apply if all particles had the same diameter.

TABLE I

PROPERTIES OF A FLUIDIZED BED ELECTRODE COMPOSED OF A NORMAL DISTRIBUTION OF COPPER PARTICLES

| $\mu_o$ (microns) | $\sigma_o$ (microns) | Number of Particles per Gram | Surface Area per Gram ($cm^2$) | Current Density* (milli amps/$cm^2$) |
|---|---|---|---|---|
| 200 | 0 | $2.68 \times 10^4$ | 33.7 | 0.485 |
| | 10 | $2.66 \times 10^4$ | 33.5 | 0.488 |
| | 50 | $2.25 \times 10^4$ | 30.1 | 0.543 |
| 500 | 0 | 1713 | 13.5 | 1.214 |
| | 10 | 1710 | 13.5 | 1.215 |
| | 50 | 1663 | 13.2 | 1.238 |

*Calculated assuming an applied current of 200 amperes and a total bed weight of 27 pounds.

GROWTH OF A FLUIDIZED BED ELECTRODE DURING ELECTROWINNING a. Basic Assumption The calculation of fluidized bed properties rests on the assumption that current density is constant over the entire electrode surface. While this is certainly not strictly accurate, it is believed to provide a good approximation to conditions in the bed. In their constant motion, bed particles come into regular contact with one another and with the feeder rods. Charges are continuously being transferred, with the net result that all particles tend to acquire the same potential as the feeder rods. It follows that the current density will tend to be constant, since two particles which have the same potential with respect to the surrounding electrolyte will have the same current density on their surfaces.

Some variation of current density can perhaps be expected for particles at different locations in the bed. Particles in the vicinity of the anode will tend to have a higher applied potential across their surfaces than particles in the immediate vicinity of the feeder rods. However, this effect will be somewhat compensated for by the fact that particles closest to the anode will tend to be at a somewhat higher potential than those farther from the anode because of the relatively long path acquired charges must travel to reach the feeder rods.

Taking account of these possible variations of current density within the bed would only have a minor effect on the results in any case. The important feature is that in any given location, it is reasonable to assume that large and small particles both have the same current densities on their surfaces. Any other effects will tend to be averaged out by the constant motion of the bed particles.

b. The Growth Process

Based on the assumption of constant current density, the basic result on which this invention is based will now be derived. This is that the diameters of all particles in the bed grow at the same rate during an electrowinning cycle.

The rate of growth of a particle at some time during the electrowinning cycle is determined by three parameters:

i. the current density on the particle at time $t$, $C_{dt}$;
ii. the efficiency of the cathodic deposition process, $\eta$; and
iii. the equivalent weight of the electrowon metal, E.

With these parameters, the rate of growth of a particle having a diameter $d_t$ at time $t$ is $$\frac{d(m_t)}{dt} = \frac{(\pi d_t^2 C_{dt})\eta E}{F}$$

where $m_t$ is the mass of the particle at time $t$, and F = 96487 is the Faraday constant.

The growth in particle mass described by equation (7) can be associated with an increase in the diameter of the particle, by making use of the fact that the increase in particle volume is equal to the increase in its mass divided by its density.

$$d\left(\frac{\pi}{6} d_t^3\right) = d(m_t)/\rho \tag{8}$$

or $$d(d_t) = \frac{2}{\pi d_t^2 \rho} d(m_t).$$

Substituting the value of $d(m_t)$ from equation (7) gives the desired result for the rate of growth of particle diameter:

$$\frac{d(d_t)}{dt} = \frac{2C_{dt}\eta E}{F\rho}. \tag{9}$$

Equation (9) is a major result, as it shows that the rate of growth of particle diameters in a fluidized electrode is not a function of the particle diameter. In fact the diameters of all particles, large and small, grow at the same rate. The value of this rate at a given time is determined by the constants of the electrowinning process, and the current density on the fluidized electrode at that time.

Since the current density at time $t$ is not directly known, a more useful form of equation (9) is obtained by replacing $C_{dt}$ by the ratio of the total applied current I to the total surface area S:

$$\frac{d(d_t)}{dt} = \frac{C}{S_t} \tag{10}$$

where $$C = (2I\eta E)/(F\rho)$$

This shows that the rate of growth of particle diameters in the fluidized electrode slows down as the electrowinning cycle proceeds and the total surface area of the electrode increases.

c. Evolution of the Distribution of Particle Diameters

Because the diameters of all particles grow at the same rate, attention will be focussed on the growth of the mean particle diameter in a given time period. $\Delta\mu$.

It is assumed that the distribution of particle diameters, P(d) $d$(d), is known at the beginning of the electrowinning cycle. After a certain time, this distribution is P(d') $d$(d') where $$P(d')\,d(d') = P(d-\Delta\mu)\,d(d-\Delta\mu)$$

or $$P(d')\,d(d') = P(d-\Delta\mu)\,d(d) \tag{11}$$

In the calculations described below, the distribution of particle diameters at the beginning of a particular cycle is simply a table of values: values of P(d) are recorded at regular intervals of the diameter $d$. The new distribution function at the end of the electrowinning function is generated by retabulating P(d) at higher values of $d$, as specified by equation (11).

It is convenient to use the distribution function at the end of the first electrowinning cycle in analytical form, since P(d) is known (equation (4)). Direct evaluation of equation (11) in this case gives $$P(d')d(d') = \frac{1}{\sqrt{2\pi}\,\sigma_o} \exp\left\{-\left(\frac{d' - \Delta\mu - \mu_o}{\sigma_o}\right)^2/2\right\} d(d'). \tag{12}$$

FIG. 1 illustrates this process with the example of an initial distribution $f_o$ (d) ($\mu_o$ = 200 microns, $\tau_o$ = 10 microns) which has been displaced 25 microns towards higher diameters by the electrowinning process, giving the resulting distribution $f_i$ (d).

d. Growth of the Surface Area of the Fluidized Electrode

The total surface area of the fluidized electrode at time $t$, $S_t$, must be known in order to calculate the time variation of particle diameters from equation (10). This is given by equation (2):

$$S_t = N\pi \int_o^\infty d_t^2 P(d_t)\, d(d_t). \tag{13}$$

The distribution of particle diameters at time $t$, P($d_t$) $d$($d_t$) is not known, since the increase in diameter from the beginning of the cycle to time $t$, $\Delta\mu_t$, is unknown. However $S_t$ (equation (13)) can be expressed in terms of the latter quantity, making use of the fact that $$d_t = d_o + \Delta\mu_t$$

and that the distribution at the beginning of the cycle, P($d_o$) $d$($d_o$), is known. The result is $$S_t = N\pi \int_{-\Delta\mu_t}^\infty (d_o + \Delta\mu_t)^2 P(d_o)\, d(d_o). \tag{14}$$

The integral in equation (14) can not be evaluated analytically, or expressed as a simple function of $\Delta\mu_t$, because $\Delta\mu_t$ appears both in the integrand and as a limit of integration. This factor makes the solution for the value of $\Delta\mu_t$ very complex.

However, the lower limit of integration is only nonzero because the Normal distribution, which has been used as a starting function, is not equal to zero at $d$=0, while physically it must be.

These difficulties have been overcome by replacing $-\Delta\mu_t$ in the integration of equation (14) by zero, and ignoring the resulting small loss in normalization. The error resulting from this approximation becomes very small as $\mu_o/\tau_o$ becomes large. Table II indicates the magnitude of this error. It is completely negligible provided $$\mu_o/\delta_o > 3,$$

and this condition has been satisfied in all of the work reported below.

TABLE II

ERROR INTRODUCED BY IGNORING THE PORTION OF THE NORMAL DISTRIBUTION BELOW d=0

| $\mu_o/\sigma_o$ | Fraction of the Distribution Ignored* |
|---|---|
| 2 | 0.023 |
| 2.5 | 0.0063 |
| 3.0 | 0.0013 |
| 4.0 | 0.00003 |

With this approximation, the total surface area of the fluidized electrode can be expressed as a simple function of $\Delta\mu_t$:

$$S_t = N\pi(I_2 + 2\Delta\mu_t I_1 + \Delta\mu_t^2 I_O) \quad (15)$$

where $$I_i = \int_0^\infty (d_o)^i P(d_o)\, d(d_o).$$

The integrals $I_i$ are simply numbers, which can be evaluated from the known distribution function $P(d_o)$ at the beginning of the electrowinning cycle being considered.

e. The Absolute Increase in Particle Diameter

The absolute increase in particle diameter during the electrowinning cycle can be calculated by integration of equation (10). Substituting the value of $S_t$ from equation (15) gives $$N\pi(I_2 + 2\Delta\mu_t I_1 + \Delta\mu_t^2 I_O)\, d(\Delta\mu_t) = C\, dt$$

where use is made of the fact that $d(d_t) = d(\Delta\mu_t)$. Integration of this equation from $\Delta\mu_t = 0$ at time $t = 0$ to $\Delta\mu_t = \Delta\mu$ at time $t = t$ gives the desired result:

$$\frac{I_o}{3}\Delta\mu^3 + I_1\Delta\mu^2 + I_2\Delta\mu - \frac{C}{N\pi}t = 0. \quad (16)$$

The increase in particle diameter in time $t$, $\Delta\mu$, has been evaluated from equation (16) using Newton-Raphson iteration. In each case the "guessed value" of $\Delta\mu$ was the value determined in the previous electrowinning cycle. The "guessed value" used for the first electrowinning cycle was calculated on the assumption that all bed particles had the same diameter $\mu_o$. Values of $\Delta\mu$ evaluated from equation (16) in this way converged to within 0.01% in three iterations, for all of the calculations which have been carried out.

Table III reports some calculated increases in mean particle diameter for typical electrowinning cycles, in each case starting with a Normal distribution. The total increase in bed weight, G, is also recorded. This is calculated from the relation $$G = \frac{I\eta E}{F}t \quad (17)$$

where t is the electrowinning time.

TABLE III

TYPICAL VALUES OF THE INCREASE IN BED WEIGHT AND PARTICLE DIAMETER DURING AN ELECTROWINNING CYCLE*

| $\mu_o$ (microns) | $\sigma_o$ (microns) | Electrowinning Time t (hours) | Increase in Diameter $\Delta\mu$ (microns) | Increase in Bed Weight G(pounds) | Increase in Bed Weight $G/W_o$(%) |
|---|---|---|---|---|---|
| 200 | 10 | 24 | 24.8 | 11.3 | 41.8 |
| | 25 | 24 | 25.4 | 11.3 | 41.8 |
| | 50 | 24 | 27.5 | 11.3 | 41.8 |
| 200 | 25 | 12 | 13.5 | 5.6 | 20.9 |
| 500 | 10 | 24 | 61.8 | 11.3 | 41.8 |
| | 25 | 24 | 62.1 | 11.3 | 41.8 |
| | 50 | 24 | 62.9 | 11.3 | 41.8 |

*Governing parameters are: Initial bed weight $W_o$ = 27 pounds; Applied current = 200 amperes; $\eta$ = 90%; Material copper.

Governing parameters are: Initial bed weight $W_o$ = 27 pounds; Applied current = 200 amperes; $\eta$ = 90%; Material copper The starting distribution in each case is assumed to be Gaussian.

The results of Table III show that the growth in particle diameter per cycle increases somewhat with increasing dispersion of the starting distribution of diameters, although this is a relatively weak effect.

SEMI-CONTINUOUS OPERATION OF THE FLUIDIZED BED ELECTRODE a. Underlying Assumption The mechanism of semi-continuous operation of a fluidized bed electrode has been outlined above. In summary, the electrowinning process is carried on for a predetermined period of time, after which the electrowon weight plus some fraction of the starting weight is withdrawn from the bed. The weight deficit is then made up with some of the starting powder, and the electrowinning process is resumed.

In order to develop a mathematical model of the fluidized electrode as it evolves through the semi-continuous operating cycle, some assumption must be made about the effect of the weight withdrawal process on the distribution of diameters of electrode particles remaining in the bed.

Several assumptions are possible. For example, it might be argued that if weight is withdrawn by gravity from the bottom of the bed, larger particles would have a greater probability of being withdrawn than smaller particles. Alternatively, if weight is withdrawn by elutriation from the top of the bed, the heavier particles would have a greater probability of being left behind. Either one of these possibilities could be allowed for by introducing a suitable diameter dependent removal function, such as for example $$R(d) = B(1 - exp[-ad^n]) \quad (18)$$

where B, $a$, and $n$ are constants determining the shape of the function.

This sort of removal function has not been used because the assignment of suitable parameters would introduce several new variables affecting the results, and indications are that the resulting improvement in accuracy would not justify the increased complexity. Several experimental measurements of the size distribution of particles withdrawn from the bottom of a fluidized bed have not indicated any significant differences from the distribution in the bed itself. This is a reasonable result, as the constant motion of the particles of the fluidized electrode, large and small, will tend to promote a very thorough mixing.

Thus it has been assumed that the withdrawal function can be approximately by a constant ($n = 0$ in equation (18)). This implies that when powder is withdrawn from the bed, the fraction of particles removed which have diameters between d and $d + d(d)$ is equal to the fraction of bed particles having diameters in this range.

b. Construction of the Distribution Function at the Beginning of a New Electrowinning Cycle The distribution of particle diameters at the end of the electrowinning cycle, $f_i(d)$, is known, having been determined as outlined above. Powder is withdrawn from the bed, leaving $N_{left}$ particles of the distribution behind. Then $N_{in}$ particles of the starting distribution are added to the bed. The resulting distribution function at the beginning of the $(i + 1)$st cycle is $$f_{i+1}(d) = \frac{N_{in}f_o(d) + N_{left}f_i(d)}{N_{in} + N_{left}} . \tag{19}$$

This process is illustrated in FIG. 1 for the beginning of the second electrowinning cycle. In this case the starting distribution of particle diameters ($f_o(d)$) was Gaussian with a mean of 200 microns and a standard deviation of 10 microns. This distribution has been shifted to the right by 25 microns in the first cycle, giving the function $f_i(d)$. In the illustrated example, the net affect of the withdrawal and addition process is that 80% of the particles in the new distribution, $f_{i+1}(d)$, come from the distribution $f_i(d)$, and 20% of the particles come from the powder which is added to the bed, $f_o(d)$. Thus in this example $N_{in}/(N_{in} + N_{left}) = 0.2$ and $N_{left}/(N_{in} + N_{left}) = 0.8$.

It is important that the number fractions of the component distribution be used in constructing the new distribution function. Because these distribution functions will in general have different mean diameters, the number fractions will be significantly different than, for example, the corresponding weight fractions. Thus, if in the example of FIG. 1 the total weight of the bed at the beginning of the second cycle were 10 pounds, more than 8 pounds of this would have come from the distribution $f_i(d)$, and less than 2 pounds from the starting distribution $f_o(d)$.

MODES OF SEMI-CONTINUOUS OPERATION OF A FLUIDIZED ELECTRODE

Several different modes of operation of the fluidized bed electrode are possible, corresponding to different schedules for the removal of powder from the bed, and the subsequent addition of fine starting powder.

In the derivation of equation (19) it was implicit that powder removal and addition both take place at the end of an electrowinning cycle. However, in a practical electrode these processes could be taking place simultaneously. Alternatively, the removal and addition processes could be staggered, so that added weight was removed in the middle of a cycle, and new powder added at the end of the cycle.

The formulation of equation (19) could be changed to take account of any of these possibilities. However, the invention will be illustrated here for the case where powder removal and addition occur simultaneously, at the end of an electrowinning cycle. The resulting picture of the fluidized bed electrode would only differ in quantative detail if the underlying operating cycle was changed.

The most obvious mode of electrode operation is at constant weight. For this mode the electrowon weight plus some fraction of the starting bed weight is withdrawn at the end of the electrowinning cycle, and enough of the starting powder is then added back to make up the weight of the electrode to its starting value. A problem with this mode of operation is that the number of particles in the electrode gradually decreases from cycle to cycle, and their average size increases, so a situation may be reached where fluidization is still no longer possible. A further problem is that because of the decreasing number of particles, the true current density on the fluidized electrode increases from cycle to cycle. This may present serious difficulties when the fluidized electrode is being used to separate two electrochemically similar reactions.

A second possibility is to operate the bed so that it contains a constant number of particles throughout the electrowinning process. This mode depends on adding more of the starting powder to the bed than the fraction of the starting weight which is removed. Constant number of particles operation could be attractive for maintaining fluidization over a long period, but the increase in bed weight with time is likely to be unacceptable. Also it has been found that in this operating mode, the current density in the fluidized electrode decreases significantly from cycle to cycle.

A third possibility, which is in accordance with the present invention, is to add just enough of the starting powder to the bed at the end of each cycle to keep the current density on the electrode constant. In order to maintain a constant current density on the electrode at the beginning of subsequent electrowinning cycles, the powder withdrawals and additions must be adjusted so that the total surface area at the beginning of each cycle is equal to its value in the starting bed, $S_0$ (equation 6).

When the electrowon weight G plus a fraction $X_f$ of the weight $W_i$ at the beginning of that cycle is withdrawn from the electrode at the end of a cycle, a fraction $W_i(1-X_f)/(W_i+G)$ of the particles will be left behind. Thus the total number of particles left will be $$N_{left} = \frac{W_i(1 - X_f)}{W_i + G} N_i , \tag{20}$$

where $N_i$ is the number of particles in the bed during the $i^{th}$ cycle. This corresponds to a total surface area of powder left in the electrode of $$S_{left}^{1} = \frac{W_i(1 - X_f)}{W_i + G} S_i \tag{21}$$

where $S_i$ is the total surface area of the electrode at the end of the $i^{th}$ cycle, and is calculated from equation (15). The new powder added to the bed must have a surface area sufficient to keep the total surface area equal to $S_o$. Thus $$S_{in}^{i+1} = S_o - \frac{W_i(1 - X_f)}{W_i + G} S_i. \quad (22)$$

Since for the starting powder the weight per unit of surface area ($W_o/S_o$) and the number of particles per unit of surface area ($N_o/S_o$) are known from equations (5) and (6), the number of particles and weight which must be added to the bed can be calculated from equation (22):

$$N_{in} = N_o\left[1 - \frac{W_i(1 - X_f)}{W_i + G}\frac{S_i}{S_o}\right], \quad (23)$$

and $$W_{in}^{i+1} = W_o\left[1 - \frac{W_i(1 - X_f)}{W_i + G}\frac{S_i}{S_o}\right]. \quad (24)$$

Table IV presents a typical schedule of weight removals and additions which would be required to hold a fluidized bed electrode at a constant current density. Although compilation of this schedule from equation (24) is quite complex and requires the use of a computer, once the schedule had been established it can be used routinely to operate the fluidized bed electrode at a constant current density.

TABLE IV

WEIGHT REMOVAL AND ADDITION SCHEDULE REQUIRED FOR SEMI-CONTINUOUS OPERATION OF A FLUIDIZED ELECTRODE AT CONSTANT CURRENT DENSITY*

| Beginning of Cycle Number | Weight Removed $W_{out}^{i+1}$ (pounds) | | Weight Added $W_{in}^{i+1}$ (pounds) | | Total Weight (pounds) | |
|---|---|---|---|---|---|---|
| | $X_f = 0.05$ | 0.20 | 0.05 | 0.20 | 0.05 | 0.20 |
| 2 | 12.6 | 16.7 | 3.9 | 7.6 | 29.6 | 29.2 |
| 3 | 12.8 | 17.1 | 3.8 | 7.5 | 31.9 | 30.8 |
| 4 | 12.9 | 17.5 | 3.6 | 7.4 | 33.9 | 32.0 |
| 5 | 13.0 | 17.7 | 3.5 | 7.3 | 35.7 | 32.9 |
| 6 | 13.1 | 17.9 | 3.4 | 7.2 | 37.3 | 33.5 |
| 7 | 13.2 | 18.0 | 3.3 | 7.2 | 38.8 | 34.0 |
| 8 | 13.2 | 18.1 | 3.2 | 7.1 | 40.0 | 34.3 |
| 9 | 13.3 | 18.2 | 3.1 | 7.1 | 41.1 | 34.5 |
| 10 | 13.4 | 18.2 | 3.0 | 7.1 | 42.1 | 34.7 |
| 11 | 13.4 | 18.2 | 3.0 | 7.1 | 43.0 | 34.8 |
| 12 | 13.4 | 18.3 | 2.9 | 7.0 | 43.7 | 34.9 |
| 13 | 13.5 | 18.3 | 2.9 | 7.0 | 44.4 | 35.0 |
| 14 | 13.5 | 18.3 | 2.8 | 7.0 | 45.0 | 35.0 |
| 15 | 13.5 | | 2.8 | | 45.5 | |
| 35 | 13.8 | — | 2.5 | — | 49.4 | — |

* Governing parameters are: Initial bed weight $W_o = 27$ pounds; $\mu = 200$ microns; $\sigma_o = 50$ microns; applied current = 200 amperes; $\eta = 90\%$; cycle length = 24 hours; material copper. The increase in bed weight in each cycle is 11.3 pounds.

It is noteworthy that the increases in bed weight reported in Table IV for conditions of constant current density operation are not unreasonably high, particularly for larger values of the replacement fraction $X_f$. This weight increase would be further reduced if the electrowinning fraction ($G/W_o$) in each cycle were smaller than the 41.8% ratio assumed in Table IV.

EVOLUTION OF THE BED TOWARDS EQUILIBRIUM

Figure 2:
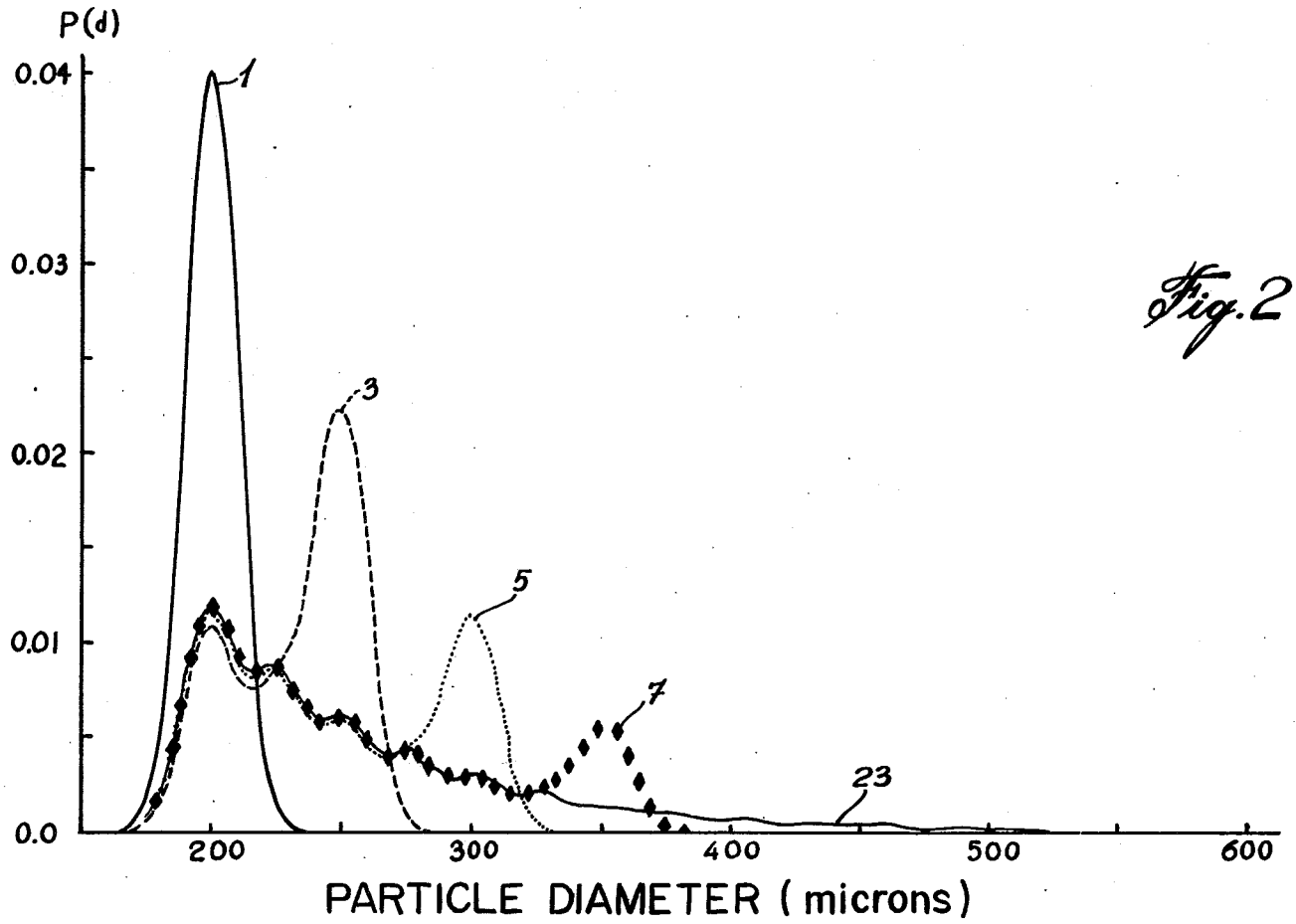
FIG. 2 illustrates the variation of the distribution of particle diameters in a fluidized bed as it evolves towards equilibrium.

FIG. 2 illustrates the variation of the distribution of particle diameters during semi-continuous operation. The starting distribution is a Gaussian distribution with a mean of 200 microns and a standard deviation of 10 microns. This is drawn in FIG. 2 as a solid curve, labelled 1, indicating that it is the distribution function at the beginning of the first electrowinning cycle.

During the first 24 hour electrowinning cycle, metal (in this case copper) is electrowon onto the 27 lb fluidized cathode at a current efficiency of 90%, with 200 amperes applied current. During this cycle the distribution of particle diameters is shifted to the right by 24.8 microns, and the total bed weight increases by 41.8% or 11.3 lbs. to a total weight of 38.3 lbs. The initial current density on the fluidized electrode at the beginning of the first cycle is 0.488 mA/cm², and this decreases during the cycle to 0.386 mA/cm².

At the end of this first cycle, the 11.3 lbs added weight, plus 10% ($X_f = 0.1$) of the starting bed weight (2.7 lbs), is withdrawn from the electrode, and 5.36 lbs of the starting powder is added back. The net effect is that the electrode is returned to its original weight of 27 lbs, plus the 2.66 lbs which must be added to reduce the starting current density on the electrode to its original value of 0.488 mA/cm². This amount (2.66 lbs) is derived by solution (24) for $W_{in}^{i+1}$. The new distribution of particle diameters at the beginning of the second cycle can now be computed directly from equation (19), when the quantities $N_{left}$ and $N_{in}$ have the values given by equations (20) and (23).

A useful parameter to characterize the distribution function of particle diameters at any point in the evolution of the fluidized bed is the mean particle diameter, evaluated from the expression:

$$\bar{d} = \int_o^\infty d\,P(d)\,d(d).$$

In the example of FIG. 2, this quantity decreases from 224.8 microns at the end of the first cycle to 218.9 microns at the beginning of cycle 2.

The theoretical electrowinning process is repeated, until the distribution of particle diameters comes to equilibrium. This is assumed to be reached when the bed weight, the number of particles per unit weight, and the mean particle diameter have all converged to the extent that they differ by less than 0.2% from the beginning of one cycle to the beginning of the next cycle. In the example of FIG. 2, this convergence has occurred after 22 electrowinning cycles.

The distribution of particle diameters at the beginning of cycle 3 is represented in FIG. 2 by a broken curve. This function has a small peak distinguishable at 200 microns, representing the contribution of added powder. The main peak is centered at 249.9 microns, and it represents the bulk of the powder which has been in the bed the beginning of the electrowinning process. This powder has now increased in diameter by 49.9 microns, 24.8 microns in the first electrowinning cycle, and 25.1 microns in the second cycle. The increase per cycle is approximately constant, because of the constant current density condition.

At the beginning of the fifth cycle, three peaks can be distinguished to the left of the main peak in the distribution function. These correspond to the repeated additions of powder averaging 200 microns diameter, with these peaks also being shifted to the right in each electrowinning cycle.

As the fluidized electrode evolves towards equilibrium, the main features of the distribution function begin to reflect the successive 10% additions of starting powder more than they reflect the original distribution of particle diameters. For example, at the beginning of the seventh cycle the mean particle diameter was 254.9 microns compared to the value of 351.3 microns which would have applied if no new powder had been added to the bed.

At the beginning of the twenty-third cycle, the process of change in the fluidized bed is complete: all evidence of the original distribution has disappeared. The distribution function has assumed a form which reflects exclusively the 10% additions of starting powder, and it retains no memory of the original bed material. The successive peaks of the equilibrium distribution function are separated by 25.6 microns, the amount by which the diameters of all particles in the bed now grow on each electrowinning cycle. Since this is a relatively large displacement with respect to the width of the distribution of the added powder, well-separated peaks can be discerned in the equilibrium distribution. If, for example, the electrowinning cycle were shorter, or if it were characterized by a lower current efficiency, these peaks would be more closely spaced with the result that the equilibrium distribution would be less structured.

EFFECT OF VARYING THE REPLACEMENT FRACTION $X_f$

Table V illustrates the variation in the aggregate properties of the fluidized electrode for different values of the replacement fraction $X_f$. It is clearly desirable to operate the electrode at the highest value of the replacement fraction which is economically feasible, since this will lead to minimum increase in the weight of the fluidized electrode over its lifetime. For example, for a replacement fraction of 20%, the bed weight increases from 27 lbs to 35.5 lbs at equilibrium, while for a replacement fraction of 5%, this weight increases to 50.4 lbs at equilibrium.

A second important feature of operating the bed at high replacement fraction is that the percentage of particles in the bed having very high diameters, for example in this case those having diameters greater than 400 microns, is much reduced. This can be important in maintaining the electrode in a fluidized state over a prolonged period.

Finally, the rate of approach of the fluidized electrode to its equilibrium condition depends very strongly on the replacement fraction. In the example of FIG. 2 and Table V, the electrode operated with a 20% replacement fraction reaches equilibrium after 14 cycles, while for a 5% replacement fraction this requires 36 – 24 hr. cycles.

TABLE V

COMPARISON OF THE AGGREGATE PROPERTIES OF FLUIDIZED ELECTRODES, FOR DIFFERENT VALUES OF THE REPLACEMENT FRACTION $X_f$*

| Parameter | $X_f$ 0.05 | 0.10 | 0.20 |
|---|---|---|---|
| Initial Number of particles in Electrode | $3.25\times10^8$ | $3.25\times10^8$ | $3.25\times10^8$ |
| Number of Particles in Electrode at Equilibrium | $1.38\times10^8$ | $1.75\times10^8$ | $2.19\times10^8$ |
| Bed Weight at Equilibrium | 50.4 lbs | 41.9 lbs | 35.5 lbs |
| 24-Hour Cycles to Equilibrium | 35 | 22 | 13 |
| Mean Particle Diameter at Equilibrium | 289.7 microns | 262.4 microns | 239.1 microns |
| Increase in Mean Particle Diameter per Cycle at Equilibrium | 25.9 microns | 25.6 microns | 25.4 microns |
| % of Particles Greater than 400 microns Diameter at Equilibrium | 11.4% | 5.6% | 1.5% |
| Current Density at Equilibrium | 0.49 mA/cm$^2$ | 0.49 mA/cm$^2$ | 0.49 mA/cm$^2$ |

* Initial Bed Weight 27 pounds, $\mu_o$ = 200 microns, and $\sigma_o$ = 10 microns. Applied current = 200 amperes, $\eta$ = 90%, and cycle time = 24 hours. Material copper.

EFFECT OF VARYING DISPERSION OF THE STARTING DISTRIBUTION

Different dispersions of the starting powder can result in very different appearances of the distribution function of particle diameters, both initially, and when the fluidized electrode reaches equilibrium. However, it has been found that these apparent differences have very little effect on the aggregate properties of the fluidized electrode. This is illustrated in Table VI, where the aggregate properties of fluidized electrodes operated at a replacement fraction $X_f = 10\%$ are compared for different dispersions of the starting material. The differences for different starting material dispersions are clearly minor, and not of consequence for practical electrowinning applications.

TABLE VI

COMPARISON OF THE AGGREGATE PROPERTIES OF FLUIDIZED ELECTRODES OPERATED AT A REPLACEMENT FRACTION OF 10%, FOR DIFFERENT DISPERSIONS OF THE STARTING POWDER*

| Parameter | $\sigma_o$ 10 microns | 25 microns | 50 microns |
|---|---|---|---|
| Initial Number of Particles in Electrode | $3.25\times10^8$ | $3.13\times10^8$ | $2.76\times10^8$ |
| Number of Particles in Electrode at Equilibrium | $1.75\times10^8$ | $1.68\times10^8$ | $1.45\times10^8$ |
| Bed Weight at Equilibrium | 41.9 lbs | 41.8 lbs | 41.2 lbs |
| 24-Hour Cycles to Equilibrium | 22 | 22 | 22 |
| Mean Particle Diameter at Equilibrium | 262.4 microns | 263.7 microns | 268.2 microns |
| Increase in Mean Particle Diameter per Cycle at Equilibrium | 25.6 microns | 26.3 microns | 28.4 microns |
| % of Particles Greater than 400 microns Diameter at Equilibrium | 5.6% | 6.1% | 8.2% |
| Current Density at Equilibrium | 0.488 mA/cm² | 0.501 mA/cm² | 0.543 mA/cm² |

* Initial Bed Weight 27 pounds, $\mu$ = 200 microns. Applied current = 200 amperes, $\eta$ = 90%, and cycle time = 24 hours. Material copper.

CURRENT DENSITY VARIATIONS

Figure 3:
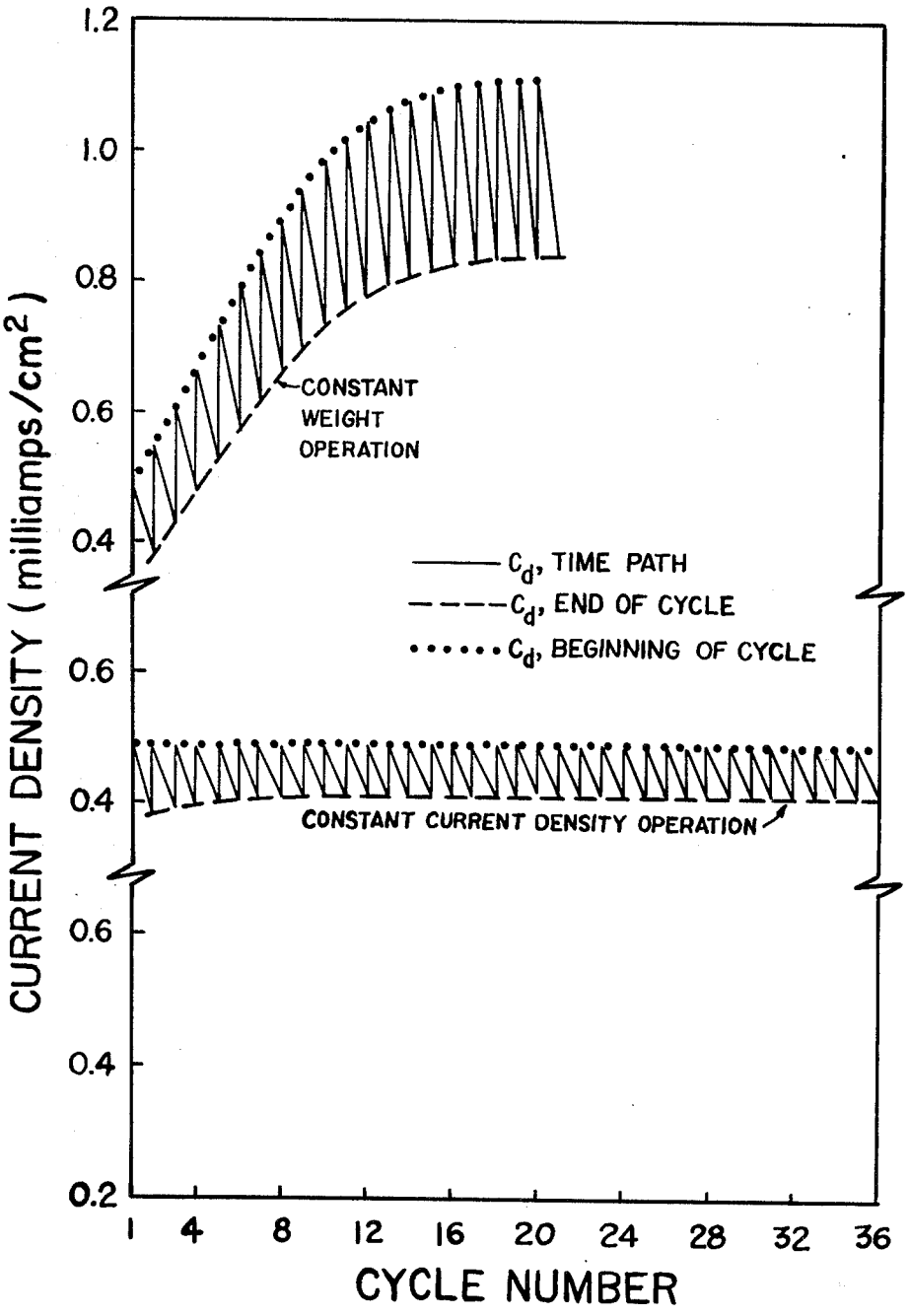
FIG. 3 illustrates the variation in current density with time for an electrode operated at constant weight and an electrode operated at constant current density.

Finally, FIG. 3 presents the variation in current density with time for the same electrode operated in the constant weight mode and in the constant current density mode. Although there are some cyclical variations in the current density in the constant current density operating mode, these are very small (less than 25%) compared with the variations which occur in the constant weight mode (approximately 195% in this example).

Although the invention has been disclosed with reference to the use of spherical particles, it is to be understood that the general evolution of bed particles in an electrode composed of non-spherical particles will be qualitatively the same as in an electrode composed of spherical particles and the results of the above calculations can still be used to estimate a suitable operation. Also, the distribution of particle diameters may vary from the Normal or Gaussian distribution disclosed above. It is believed that the Gaussian distribution can be used as a reasonable approximation to the types of powders which will normally be encountered in practical applications.

Although the description of the operation of the fluidized bed electrode has been made with reference to semi-continuous operation, i.e., the case where electrowinning is stopped at the end of each cycle for withdrawal and addition of powder material, it is to be understood that electrowinning could be continuous and each withdrawal and addition of powder material be spread over a predetermined length of time within each cycle of operation.

What is claimed is:

1. A method for the operation of a fluidized bed electrowinning electrode made of fine particles at an approximately constant current density for a prolonged period of time, comprising the steps of:

a. electrowinning for a number of periods of predetermined duration;

b. withdrawing from the fluidized bed during each period, a weight of particles equal to the electrowon weight plus some fraction of the bed weight; and c. adding to the fluidized bed, during each period, a predetermined weight of the starting bed particles enough to maintain the total surface area of the fluidized bed electrode approximately constant, such predetermined weight being determined substantially by the formula:

$$W_{in} + 1 = W_o\left[1 - \frac{W_i(1 - X_f)}{W_i + G}\ \frac{S_i}{S_o}\right],$$

wherein:

$W_o$ = original electrode weight, $S_o$ = original total surface area of the electrode, $W_i$ = electrode weight at a predetermined time in the preceding period, $G$ = electrowon weight, $S_i$ = total surface area of the electrode at such predetermined time in the preceding period, and $X_f$ = fraction of the weight $W_i$ of the electrode withdrawn in addition to the electrowon weight at such predetermined time in the period.

2. A method as defined in claim 1, wherein electrowinning is done semi-continuously.

3. A method as defined in claim 2, wherein the particle removals and additions take place at the end of each cycle.

4. A method as defined in claim 3, wherein the fraction of the starting bed weight removed is higher than 5%.

5. A method as defined in claim 4, wherein the fraction of the starting bed weight removed is between about 5 and 20%.

6. A method as defined in claim 1, wherein the particles are approximately spherical and wherein the distribution of particle diameters is approximately Gaussian.

* * * * *